United States Patent [19]

Capes et al.

[11] 3,969,103

[45] July 13, 1976

[54] METHOD OF PRODUCING BALL AGGLOMERATED PARTICULATE MATERIAL

[75] Inventors: Charles E. Capes; Allan E. McIlhinney; Ira E. Puddington, all of Ottawa, Canada

[73] Assignee: Canadian Patents and Development Limited, Ottawa, Canada

[22] Filed: Nov. 29, 1974

[21] Appl. No.: 528,541

[30] Foreign Application Priority Data

Feb. 25, 1974 Canada ..... 193397

[52] U.S. Cl. ..... 75/3; 264/117

[51] Int. Cl.[2] ..... C22B 1/08; C09C 1/56

[58] Field of Search ..... 75/3; 264/117

[56] References Cited

UNITED STATES PATENTS

| | | | |
|---|---|---|---|
| 2,792,298 | 5/1957 | Freeman | 75/3 |
| 2,793,109 | 5/1957 | Huebler | 75/3 |
| 3,536,475 | 10/1970 | Trub | 75/3 |

*Primary Examiner*—Peter D. Rosenberg
*Attorney, Agent, or Firm*—Francis W. Lemon

[57] ABSTRACT

Ball agglomerated particulate material is produced by comminuting the material to produce coarse particles having a size predominantly within the range 0.3 mm to 1.4 mm, and fines, then feeding the coarse particles, fines and an agglomerating liquid into a rotating ball agglomerating mill with the volume fraction of the coarse particles being 20% to 80% by volume of the total solids feed to the mill, continuing rotation of the mill until agglomerated balls are produced having a continuous network of fines interspersed with the coarse particles such that:

$$\left(\frac{1-\epsilon}{\epsilon}\right)\Big/\left(\frac{1-\epsilon_0}{\epsilon_0}\right) = K\left(\frac{1}{1-m}\right)$$

where $\epsilon$ = the porosity of the agglomerates, $\epsilon_0$ = the porosity of similar agglomerates formed entirely of the fines, $m$ is the above mentioned volume fraction of coarse particles, and $K = 0.7$ to $1.0$, and removing the agglomerates thus formed from the ball agglomerating mill. It has been found, according to the invention, that the proportion of coarse particles to fines can be increased, and that the size of the coarse particles can be increased beyond the limits believed practical to obtain ball agglomerates of adequate green strength, and this has the advantage of reducing the costs involved in comminuting the material.

5 Claims, 8 Drawing Figures

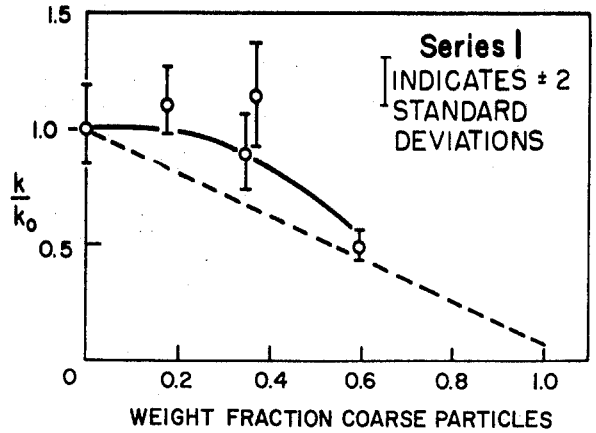
Fig. I
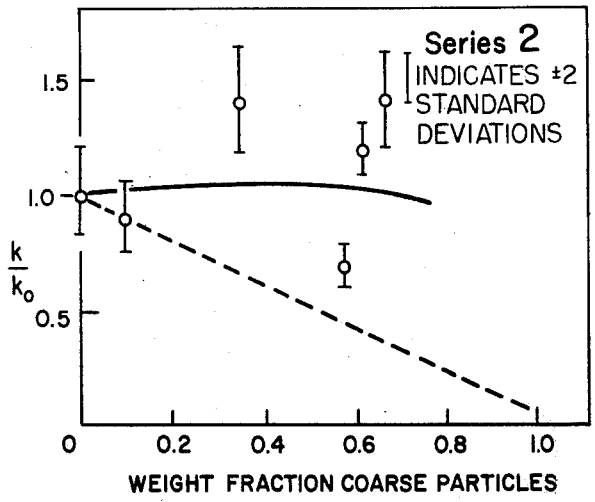
Fig. 2
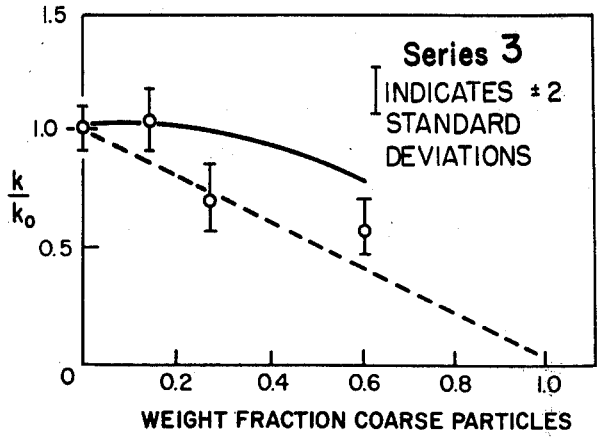
Fig. 3

METHOD OF PRODUCING BALL AGGLOMERATED PARTICULATE MATERIAL

This invention relates to a method of producing ball agglomerated particulate material.

During size enlargement by ball agglomerating a moist, particulate material, there is a balance between the destructive forces within the turbulent, moist, particulate material being agglomerated, and the cohesive forces holding together the ball agglomerates already formed. The ball agglomerates must be sufficiently strong to nucleate and grow in size in the ball agglomerating mill, and to survive subsequent handling and treatment. Green strength, that is the strength of a ball agglomerated, moist particulate mass, is due to negative capillary pressure within liquid in the interstices between the particles, and this negative capillary attraction is caused by the curvature of the liquid in capillary pores formed by the interstices between particles.

Green strength is improved as the average size of the capillary pores formed by the interstices between particles is decreased, and thus the particle size of the particulate mass in an important variable. It has generally been accepted for many years that there is a maximum particle size from which satisfactory ball agglomerates can be formed, the limit being given, for example, as a top size of 30 to 50 mesh with at least 25% minus 200 mesh for various materials on a disc pelletizer, see W. H. Engelleitner, "Pelletizing Disc Applications in Ceramic Processing", Ceramic Age, 22 (December), 1966, page 24, and 60 weight % finer than 325 mesh for iron or pelletization, see F. D. Devaney and M. H. Childs, "Pelletizing", in "Blast Furnace — Theory and Practice", J. H. Strassburger (Ed.), Gordon and Breach, New York, N.Y., 1969, pages 279 to 323. In some cases a sufficiently fine particle size is available from a previous processing step, for example, iron ores must normally be finely ground to liberate impurities during upgrading prior to ball agglomerating. In other cases, however, grinding to a fine size to allow satisfactory ball agglomerating within the above limits may represent an added cost.

It has already been proposed by K. E. Merklin and F. D. Devaney, "The Coarse Specularite — Fine Magnetite Pelletizing Processl", in "Agglomeration", W. A. Knepper Ed., Interscience (N.Y.), 1962, pages 965 to 978, that medium grade iron ores in the Wabush Lake deposit of Labrador, Canada, containing, say, 30% of the recoverable iron units in the form of magnetite, with most of the balance specular hematite, can be agglomerated in a satisfactory manner from a mixture of 70% by weight coarse ground specular hematite therefrom having a particle size predominantly within the range 48 to 200 mesh and the balance finely ground magnetite having fines predominantly of a particle of −325 mesh. This proposal has the advantage that specular hematite can be economically liberated from medium grade Wabush Lake ores, to produce a high grade concentrate, at about 28 mesh, while the magnetite is slightly finer grained and must be liberated at about −65 mesh to produce a desirable separate concentrate, and so the costs of grinding the specular hematite and magnetite to suitable particle sizes for the ball agglomeration are considerably reduced. The interstices between the coarse hematite particles were found to be occupied to a large extent by the magnetite fines which provided the surface area to hold the agglomerate balls together in the green and dry state.

It would be desirable to produce ball agglomerated particulate material wherein the predominant size range of the coarse particles, and the volume ratio of coarse particles to that of fines, is larger than that of known feed materials for ball agglomerated particulate material and yet the ball agglomerates so produced have adequate strength during ball agglomeration and subsequent processing thus effecting an economy in the grinding of the coarse particulate material.

It is an object of the present invention to provide a method of producing ball agglomerated particulate material wherein the predominant size range of the coarse particles, and the volume ratio of coarse particles to that of fines, is larger than that of known ball agglomerated particulate material and yet the ball agglomerates so produced have adequate strength during ball agglomerating and subsequent processing thus effecting an economy in the grinding of the coarse particulate material.

According to the present invention there is provided a method of producing ball agglomerated particulate material, comprising:

a. comminuting the material to produce particulate material therefrom consisting of coarse particles having a particle size predominantly within the range 0.3 mm to 1.4 mm, and fines, predominantly less than 0.2 mm b. feeding into a rotating, ball agglomerating mill a feed consisting of the coarse particles, the fines and an agglomerating liquid, with the volume fraction (m) of the coarse particles being in the range 20% to 80% of the total solids content of the total feed, c. continuing rotation of the ball agglomerating mill until agglomerated balls of the particulate material are produced having a continuous network of the fines interspersed with the coarse particles such that:

$$\left(\frac{1-\epsilon}{\epsilon}\right) \Big/ \left(\frac{1-\epsilon_o}{\epsilon_o}\right) = K \left(\frac{1}{1-m}\right)$$

where $\epsilon$ = the porosity of the agglomerates, $\epsilon o$ = the porosity of similar agglomerates formed entirely of the fines, m is the above mentioned volume fraction of coarse particles, and $K = 0.7$ to $1.0$ and then d. removing the agglomerated balls from the ball agglomerating mill.

In one embodiment of the present invention the coarse paraticles and the fines are premixed in a dry condition with the coarse particles being 20% to 80% by volume of the total solids content, and then this dry premix is fed into the rotating, ball agglomerating mill together with the agglomerating liquid.

Thus is will be seen that while K. E. Merklin and F. D. Devaney went so far as to use a relatively coarser particle size range than had previously been used, the fact that they only mixed the coarse particles of specular hematite in the range that these iron particles could be liberated with the necessary purity from the iron ore did not lead them or anyone else skilled in the art to believe that it was possible to ball agglomerate coarse particles having a particle size predominantly larger than the range 48 to 200 mesh and produce adequately strong ball agglomerates for the agglomerating process and subsequent handling and processing.

It has been found according to the present invention, that the size and proportion of coarse particles can be increased beyond the limits believed practical to obtain ball agglomerates of adequate green strength, and this has the advantage of reducing the costs involved in comminuting the material.

In the accompanying drawings which show graphs prepared from tests made to verify the present invention:

FIGS. 1 to 6 show graphs with $k/k_o$, a dimensionless strength factor for ball agglomerates, plotted against the quantity of coarse particles present in the ball agglomerates.

Figure 4:
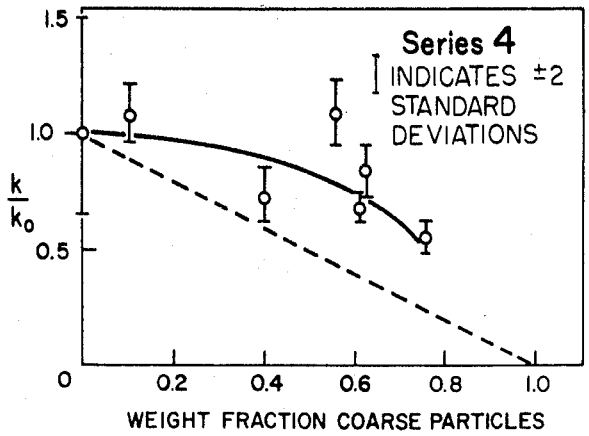
Figure 5:
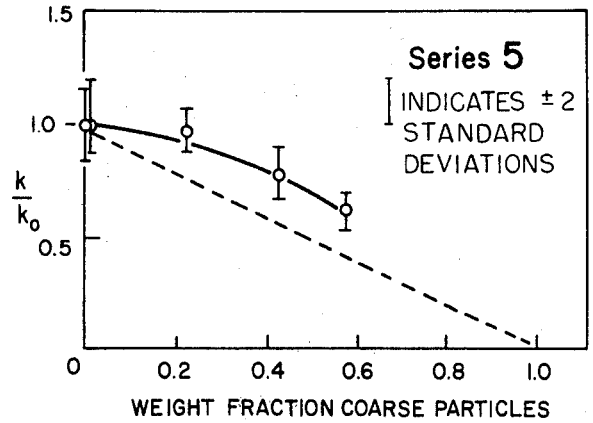
Figure 6:
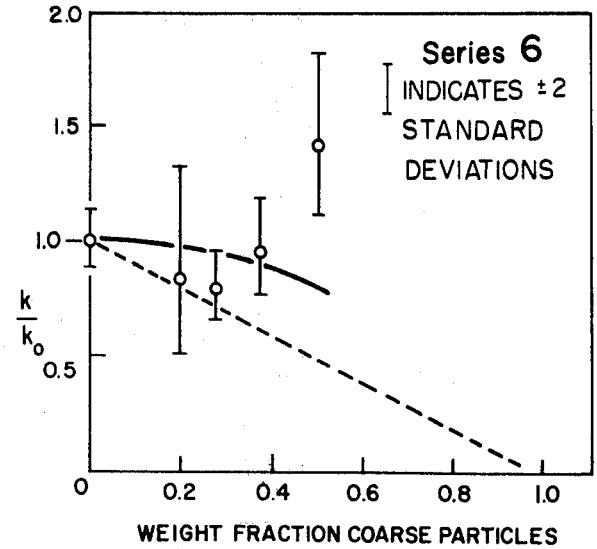

The green strength of ball agglomerates has generally been represented by an equation of the form $$L = k\,D^n \qquad (1)$$

where L is the load at failure under compression, D is the ball agglomerate diameter and k and n are constants. For ball agglomerates held together by negative capillary pressure, $n$ is normally close to 2. The strength factor $k$ is proportional to the cohesive forces acting within the agglomerate. These may be calculated from the fundamental equations for pressure difference across a curved air-liquid interface in which capillary radius is related to powder properties by means of an hydraulic radius based on the specific surface of the particles, S, and the porosity, $\epsilon$, of the agglomerates. For agglomerates in the capillary state in which the moisture completely wets the solid:

$$\frac{L}{D^n} = k = q \left(\frac{1-\epsilon}{\epsilon}\right) \sigma\rho S \qquad (2)$$

where $\sigma$ is the liquid surface tension and $\rho$ the particle density. The constant q depends upon the mechanism of failure of the ball agglomerates and upon the particle shape and size distribution. For ball agglomerates composed of sand fractions of "reasonably uniform dimensions" in which S was determined (apparently) by a permeability technique, $q = 0.56$.

For real systems which may contain a wide distribution of particle sizes, it may be hypothesized that the largest particles have essentially no effect on agglomerate strength. The strength may then be assumed equal to that of a mass formed exclusively of fine materials when the magnitude of the surface roughness of the larger particles is of the same order as the size of the small particles. For the present invention the applicants have shown this quantitatively in eq. (2) for a ball agglomerate formed from a binary mixture of two uniformly-sized particles one of which is much larger than the other. If the coarse particles do not disturb the packing of the fines surrounding them, the expression $(1-\epsilon)/\epsilon$ for the binary system becomes:

$$\frac{1}{1-m}\left(\frac{1-\epsilon_o}{\epsilon_o}\right) \qquad (3)$$

where $\epsilon_o$ is the porosity of a ball agglomerate formed entirely from fines and m is the volume fraction of coarse particles in the mixture. The specific surface of the mixture may be approximated by:

$$(1-m)S_o \qquad (4)$$

where $S_o$ is the specific surface of the fines. When (4) and (3) are substituted into (2), the $(1-m)$ terms disappear to leave the equation unchanged. In other words, if the packing of the fines is not affected by the presence of coarse particles, the green strength of ball agglomerates of the binary mixture should equal that of the aggregate formed only from fines.

The following tests were carried out to verify the present invention using sands, gravel and glass beads in addition to two systems composed of iron ore as examples of particulate materials. These particulate materials were tested on a batch laboratory scale using a balling disc as the rotating ball agglomerating mill. The main part of the tests was a study of the green strength of ball agglomerates formed from six series of binary mixtures of coarse particles and fines listed in the following Table 1.

Table 1

| Series No. | Properties of Particles 1 | 2 | 3 | 4 | 5 | 6 |
|---|---|---|---|---|---|---|
| Fine Material | | | | | | |
| Type | Ball Milled Sand | Ball Milled Sand | Ball Milled Sand | Ball Milled Sand | Specular Hematite | Magnetite |
| Particle density (g/cm³) | 2.67 | 2.67 | 2.67 | 2.67 | 4.75 | 4.96 |
| Surface area (m²/g) | | | | | | |
| Nitrogen adsorption | 0.31 | 0.66 | 0.61 | 0.67 | 2.96 | 1.61 |
| Liquid permeability | | | | 0.285 | 0.745 | 0.219 |
| Size analysis | | | | | | |
| 10 Wt.% larger than | 100μ | 47μ | 46μ | 42μ | 28μ | 72μ |
| 10 Wt.% finer than | 13μ | 9μ | 13μ | 10μ | 5μ | 12μ |
| Coarse Material | | | | | | |
| Type | Sharp Sand | Sharp Sand | Glass Beads | Gravel | Specular Hematite | Magnetite |
| Particle density (g/cm³) | 2.67 | 2.67 | 2.90 | 2.64 | 4.75 | 3.88 |
| Size Range | | | | | | |
| Finer than | 700μ | as in | 1190μ | 1410μ | 600μ | 1168μ |
| Larger than | 250μ | 1 | 1000μ | 1190μ | 350μ | 1000μ |

Note:
The fines used in series 2–4 was the same sample which showed small changes in size distribution due to handling during the experiments.

Ball agglomerating can be carried out in an 8½ in. diameter pan using water as the agglomerating liquid to form agglomerates in the range 0.2 to 0.8 in. A technique used consisted of premixing the coarse particles with the fines in a dry state in small quantities prior to use in the ball agglomerating process. The ball agglomerates were formed by initial nucleation and subsequent layering to the required size.

An Instron (Trademark) tester (model 1133) operated at a constant deformation rate of 0.5 cm/min. was employed to measure the crushing strength of a representative portion of the ball agglomerates. Other parameters determined included moisture content, proportion of coarse and fine particles and pellet density.

Some difficulty was experienced in forming ball agglomerates with the larger proportions (i.e. 40% to 80%) of the coarser materials. The coarse particles resisted incorporation into the ball agglomerates with the result that their proportion in the final product, on the average, was less than that in the feed mixture. This tendency is probably related to the greater inertia of the coarser particles which caused them to resist bond formation with the ball agglomerates and confirms that ball agglomerates using coarse materials have a slower forming time and would probably result in lower feed rates and higher circulating loads in a continuous balling circuit.

The ball agglomerate strength data were correlated by means of eq. (1) using a least squares procedure. The index n had a mean value of 1.9 with a standard deviation of 0.2. To allow the effect of adding coarse particles to a matrix of fines to be assessed, the strength factor $k$ for each experiment was divided by $k_o$, the strength factor for 100% fines. These dimensionless strength factors are plotted in FIG. 1 to 6, for Series Nos. 1 to 6 respectively, as a function of the amount of coarse material present while the values of $k_o$ and of $q_o$ from eq. (2) are given below:

| Series No. | $k_o$ (eq. 1) (g/cm²) | | $q_o$* (eq. 2) |
|---|---|---|---|
| 1 | 150 | | |
| 2 | 398 | | Avg. |
| 3 | 425 | = | 0.447 |
| 4 | 402 | | |
| 5 | 2110 | | 0.248 |
| 6 | 604 | | 0.233 |

*Based on the fine particle surface area by liquid permeability.

For the fine sand in series 2 to 4, $q_o$ was equal to 0.45. For the iron ores in series 5 and 6, $q_o$ was considerably smaller, apparently due to differences in particle shape and roughness. (c.f. specific surface measurements in Table 1).

Returning to the normalized strength factors in FIG. 1 to 6 it is evident that within experimental error, the addition of up to 20 or 30% of the coarse component has generally not reduced ball agglomerate strength below that for the system containing only fines. In the range 40–80% coarse material, the strength was not diminished for some of the binary mixtures while for others, a considerable reduction was found. In eq. (2), it is evident that in these experiments with surface tension and particle density constant for a given series, strength is controlled by the specific surface, S, and the particle packing factor, $(1-\epsilon)/\epsilon$. From expression (4), the specific surface reduces in direct relation to the proportion of fines remaining in the mixture and this is indicated by the dashed lines in FIGS. 1 to 6. The continuous line in the FIGS. 1 to 6 indicates the effect of changes in both particle surface area and packing factor as given by equation (2).

For the strength to remain undiminished, expression (3) shows that the packing factor $(1-\epsilon)/\epsilon$ must increase in inverse relation to the proportion of fines remaining.

Figure 7:
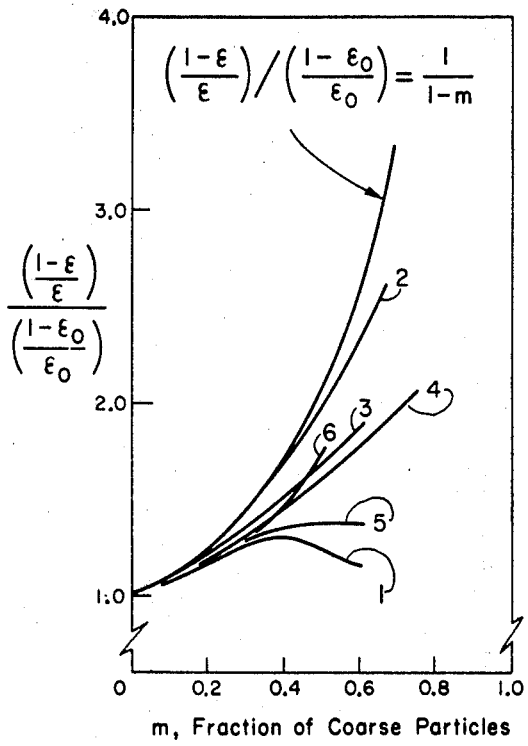
FIG. 7 is a graph showing the experimental and "ideal" packing of ball agglomerates plotted against the fraction of coarse particles contained in the ball agglomerates.

In FIG. 7, this "ideal packing" is shown as the uppermost curve while the other curves indicate the relationship found experimentally and are designated by the same reference numeral as the Series No. to which they correspond. As would be expected, the series which approached the ideal packing most closely (series 2, 4 and 6) produced the highest strength factors while those which deviated most from the ideal case (series 1 and 5) yielded the lowest strength factors at higher proportions of coarse particles. Series 3 deviated from this pattern as will be discussed further below. The general agreement between the theory and experiment is further illustrated by the solid curves in FIG. 1 to 6 which were calculated from eq. (2) and combine the effects of specific surface and packing factor.

It is evident, then, that the surface area of a balling mixture is not the only factor controlling the process as has frequently been assumed; the packing factor $(1-\epsilon)/\epsilon$ is also important. In the present results, surface area was decreasing steadily as the proportion of coarse particles grew but agglomerate strength was unaffected or reduced at a slower rate due to improved packing. Thus rationalization of these results reduces to a question of the effect of the coarse particles on the packing density of the mixture. Although the mixture will normally increase in density, the extent of the increase depends upon factors such as the proportion of coarse particles and the shape and size ratio of the particles.

The role of these variables affecting density can only be described qualitatively. For example, to improve packing density, the size ratio of the particles of a binary mixture must be sufficiently large for the fines to be able to penetrate the voids between the coarse particles; at least a sevenfold difference in size between the components is indicated to ensure closest packing. This is demonstrated by a comparison of series 1 and 2 in which the improvement in packing and thus in ball agglomerate strength in series 2 is probably explained by the smaller fines size in this series. Regarding the cases with larger proportion of coarse particles, the larger particles may begin to touch each other and there may be insufficient fines to fill the voids between them; as a result, porosity for the combination increases. These effects appear to account for the reduced strengths observed at coarse fractions greater than 0.6, for example in series 4. It was very difficult to form aggolmerates at fractions of coarse particles greater than 0.8 in these experiments due to low particle cohesion with such small proportions of fines.

Perhaps the most complex variable to deal with in the packing of powders is particle shape. This factor probably accounts for the results in series 3 in which, even though the results are better than would havee previously been expected, the theoretical approach predicts greater strengths than were actually observed. It must be noted, however, that eq. (2) assumes an essentially homogeneous pore space which can be represented by average parameters derived from surface area and porosity. In series 3, the very regular spherical surfaces of the coarse particles would result in much larger pores at these surfaces than in the interior of the fines phase where the irregular surfaces should fit closely together.

It is suggested that these larger pores acted as a path of weakness in the agglomerates leading to failure at loadings lower than predicted by theory bases essentially on the structure of the fines portion. Similarly, low density packing near the rounded gravel particles in series 4 may account for the higher porosity obtained in this series compared with series 2. Note that greater density might have been expected in series 4 due to the large size ratio of the particles.

Particle shape also appears to have been important in series 5 in which the specular hematite particles were in the form of flat platelets. On the one hand, these flat surfaces might be expected to fit closely together and yield high density. On the other hand, close contact between the surfaces of the coarser particles may prevent the fines from passing into the pore spaces between the particles, resulting in poor packing. The latter seems to have occurred in the present experiments.

Thus from FIG. 7 it can be deduced that when, according to the present invention, $$\left(\frac{1-\epsilon}{\epsilon}\right) \Big/ \left(\frac{1-\epsilon_o}{\epsilon_o}\right) = K \left(\frac{1}{1-m}\right)$$

where $\epsilon$ = the porosity of the agglomerates, $\epsilon_o$ = the porosity of similar agglomerates formed entirely of the fines, $m$ = the volume fraction of the coarse particles and is in the range 20% to 80% of the solids volume of the total feed to a rotating ball agglomerating mill, and K = 0.7 to 1.0 then ball agglomerates having the necessary green strength are produced.

Figure 8:
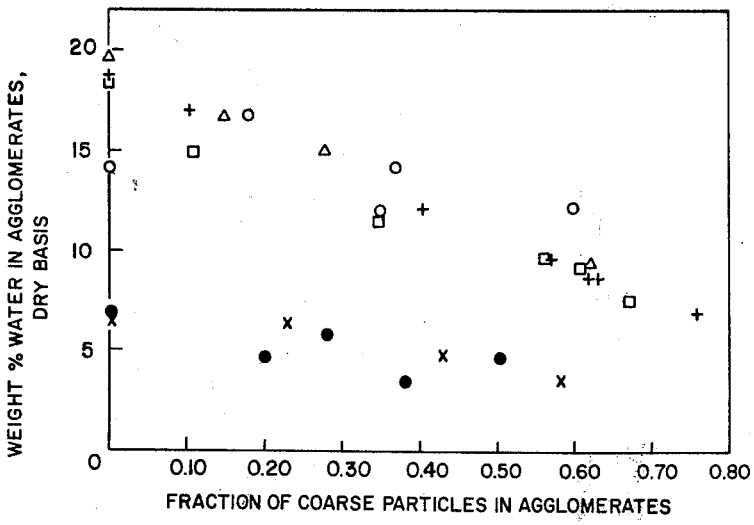
FIG. 8 is a graph showing the weight % of water present in ball agglomerates, dry basis, plotted against the fraction of coarse particles contained in the ball agglomerates.

A further interesting feature of the agglomerates containing substantial proportions of very coarse particles is shown in FIG. 8, where o represents Series No. 1, □ represents Series No. 2, Δ represents Series No. 3, + represents Series No. 4, $x$ represents Series No. 5, and ○ represents Series No. 6. As the amount of coarse material increases, the moisture content of the aggregates decreases. Capillary state agglomerates are known to contain sufficient liquid approximately to saturate their internal void spaces with the result that the moisture content decreases as the packing density improves. Thus one may expect that agglomerates incorporating significant proportions of coarse particles require less drying energy and time than conventional green pellets.

The tests support the theoretical analysis of the strength of ball agglomerates, according to the present invention, held together by capillary forces. In particular, the importance of not only high particle surface area but also of dense particle packing in producing strong green ball agglomerates has been shown. Although the introduction in accordance with the present invention of coarse particles into an agglomerate of fines results in lower particle surface area, ball agglomerate strength need not be greatly reduced provided a compensating increase in packing density is produced as previously described. This may be accomplished with proper regard for the effects of particle shape, size distribution, etc. on the porosity of the coarse-fine-mixture.

Although there is evidence that the presence of coarse grains leads to a more difficult balling operation, this disadvantage is offset by a number of factors. These include less grinding of the feed material and lower moisture content and higher density in the product. Lower moisture content coupled with the probability of relatively large inter-connected vapour release channels at the coarse-fine interfaces suggest the possibility of very rapid drying rates without ball agglomerate damage. Higher green density should lead to easier sintering if this is required in subsequent processing.

Similar tests to those of Series No. 2 in Table 1, were carried out in a so called "wet" system to verify that the present invention could be used with such a system. The particulate material was ball agglomerated under a blanket of a light petroleum distillate. The results obtained showed that, using the method according to the present invention, ball agglomerates can be produced having similar strength to those given above, with the volume fraction ($m$) of the coarse particles being in the range 20% to 80% of the total solids of the total feed to the ball agglomerating mill.

In this patent specification particulate material is intended to include particulate material of one or more chemical or physical compositions, that is:

1. all of the particles may be of the same chemical or chemical composition, 2. the coarse particles may be of one chemical or chemical composition and the fines may be of different chemical or chemical composition, or 3. a portion of the coarse particles and/or fines may be of one chemical or chemical composition and the remaining coarse particles and/or fines of a different chemcial or chemical composition.

It is within the scope of the present invention to obtain the coarse and fine particles from the size reduction product of one material such as an ore.

We claim:

1. A method of producing ball agglomerated particulate material, comprising:

a. comminuting the material to produce particulate material therefrom consisting of coarse particles having a particle size predominantly within the range 0.3 mm to 1.4 mm, and fines having particles predominantly less than 0.2 mm, b. feeding into a rotating, ball agglomerating mill a feed consisting of the coarse particles, the fines and an agglomerating liquid, with the volume fraction ($m$) of the coarse particles being in the range 20% to 80% of the total solids content of the total feed, c. continuing rotation of the ball agglomerating mill until agglomerated balls of the particulate material are produced having a continuous network of the fines interspersed with the coarse particles such that:

$$\left(\frac{1-\epsilon}{\epsilon}\right) \Big/ \left(\frac{1-\epsilon_o}{\epsilon_o}\right) = K \left(\frac{1}{1-m}\right)$$

where $\epsilon$ = the porosity of the agglomerates, $\epsilon_o$ = the porosity of similar agglomerates formed entirely of the fines, $m$ is the above mentioned volume fraction of coarse particles, and $k$ = 0.7 to 1.0 and then d. removing the agglomerated balls from the ball agglomerating mill.

2. A method according to claim 1, wherein the coarse particles and the fines are premixed in a dry condition with the coarse particles being 20% to 80% by volume of the total solids content, and then this dry premix is fed into the rotating, ball agglomerating mill together with the agglomerating liquid.

3. A method according to claim 1, wherein the coarse particles and the fines are agglomerated under a blanket of the agglomerating liquid.

4. A method according to claim 1, wherein the coarse particles and the fines are of the same substance.

5. A method according to claim 1, wherein the coarse particles are of a different substance to the fines.

* * * * *